US012710054B2

(12) United States Patent
de Araujo Pereira Andrade et al.

(10) Patent No.: US 12,710,054 B2
(45) Date of Patent: Aug. 18, 2026

(54) PACKAGED FAN

(71) Applicant: Evapco, Inc., Taneytown, MD (US)

(72) Inventors: Ricardo de Araujo Pereira Andrade, Itu—SP (BR); Luigi Martini, Itu—SP (BR)

(73) Assignee: Evapco, Inc., Taneytown, MD (US)

( * ) Notice: Subject to any disclaimer, the term of this patent is extended or adjusted under 35 U.S.C. 154(b) by 0 days.

(21) Appl. No.: 19/279,421

(22) Filed: Jul. 24, 2025

(65) Prior Publication Data

US 2026/0028995 A1 Jan. 29, 2026

Related U.S. Application Data

(60) Provisional application No. 63/675,002, filed on Jul. 24, 2024.

(51) Int. Cl.

| | |
|---|---|
| ***F04D 29/52*** | (2006.01) |
| ***F04D 19/00*** | (2006.01) |
| ***F04D 25/06*** | (2006.01) |
| ***F04D 29/66*** | (2006.01) |

(52) U.S. Cl.

CPC ..... *F04D 29/522* (2013.01); *F04D 19/002* (2013.01); *F04D 25/0606* (2013.01); *F04D 29/668* (2013.01)

(58) Field of Classification Search

CPC .... F04D 19/002; F04D 25/0606; F04D 25/08; F04D 25/082; F04D 25/12; F04D 29/522; F04D 29/644; F04D 29/668

See application file for complete search history.

(56) References Cited

U.S. PATENT DOCUMENTS

| | | | | | |
|---|---|---|---|---|---|
| 1,781,155 | A | * | 11/1930 | Anderson | F04D 29/646 417/423.15 |
| D249,158 | S | * | 8/1978 | Morrow | D23/379 |
| 4,394,111 | A | * | 7/1983 | Wiese | F24F 13/20 415/214.1 |
| 4,685,513 | A | * | 8/1987 | Longhouse | F28F 9/002 416/189 |
| 5,131,352 | A | * | 7/1992 | Hoshino | F04D 29/545 416/247 R |
| 5,460,485 | A | * | 10/1995 | Sugiyama | F04D 29/663 264/318 |
| 5,582,507 | A | * | 12/1996 | Alizadeh | F04D 29/329 416/169 R |

(Continued)

FOREIGN PATENT DOCUMENTS

| | | | | |
|---|---|---|---|---|
| DE | 19521393 | A1 * | 12/1996 | F04D 29/646 |

OTHER PUBLICATIONS

International Search Report and Written Opinion issued in Application No. PCT/US2025/039101 dated Oct. 20, 2025, 8 pages.

*Primary Examiner* — Brian P Wolcott

(74) *Attorney, Agent, or Firm* — Bookoff McAndrews, PLLC

(57) ABSTRACT

A packaged fan having a hub, a rotor, fan blades extending outward from said rotor, an electric motor electrically coupled to said rotor, a fan casing surrounding an outside perimeter of said fan blades, and a plurality of support vanes extending from said hub to outside said fan casing and configured to attach to a support structure, the support vanes having planar portion traversing an air flow path, the planar portion having a major plane that is parallel to said air flow path.

20 Claims, 3 Drawing Sheets

(56) References Cited

U.S. PATENT DOCUMENTS

| | | | | |
|---|---|---|---|---|
| 6,638,037 | B2 * | 10/2003 | Grant | F04D 29/646 417/423.15 |
| 7,114,921 | B2 * | 10/2006 | Iwasaki | F04D 29/326 416/189 |
| 7,220,102 | B2 * | 5/2007 | Cho | F04D 29/544 415/220 |
| 7,687,953 | B2 * | 3/2010 | Rahbar | F04D 25/0606 310/239 |
| 7,789,622 | B2 * | 9/2010 | Acre | F04D 29/526 416/189 |
| 8,672,615 | B2 * | 3/2014 | Ruckert | F04D 25/0613 415/214.1 |
| 10,982,914 | B2 * | 4/2021 | Glickman | F28D 1/0443 |
| 2003/0133815 | A1 | 7/2003 | Grant | |
| 2008/0075585 | A1 | 3/2008 | Acre | |
| 2008/0223558 | A1 * | 9/2008 | Otsuki | H01L 23/4093 165/121 |
| 2018/0187688 | A1 * | 7/2018 | DeFilippis | F04D 29/526 |
| 2022/0170469 | A1 * | 6/2022 | Van Houten | F04D 29/644 |
| 2024/0384879 | A1 * | 11/2024 | Nguyen | F04D 19/002 |

* cited by examiner

PACKAGED FAN

FIELD OF THE INVENTION

This invention relates to packaged fans of the type used in cooling towers, coolers, condensers, evaporators, and the like.

BACKGROUND OF THE INVENTION

Packaged fans are commonly used on applications requiring air movement to allow heat transfer such as in cooling towers, coolers, condensers and evaporators. These devices can be used on cooling and refrigeration applications such as HVAC, industrial refrigeration, power generation, process cooling, steam condensing, data centers, food processing, meat and dairy production.

A packaged fan usually consists of a rotor, an electric motor, a fan casing and a protection screen. The fan casing generally includes an inlet bell and can also include a pressure recovery stack. The integration of all these parts is critical to the performance of the packaged fan.

There are many different designs available on the prior art including alternated current (AC) and electronically commuted (EC) electric motors, external rotor and internal rotor electric motors, one piece and multi-piece rotors, one piece and multi-piece fan casings, inlet bell or pressure recovery stack integrated to the fan casing or as a separate part. In the design of packaged fans, the challenge is achieving adequate mechanical strength of the fan at reasonable manufacturing cost without sacrificing fan efficiency.

Among prior art solutions for this challenge, are DE202015101205, which discloses a single piece casing with separate external reinforcements, U.S. Pat. No. 9,074,611B2, which discloses a multi-piece casing with connecting elements on each casing piece, and DE102012004617, which discloses multiple support structures attaching the motor to the fan casing. These prior art solutions have the disadvantage that they require expensive tooling for manufacturing, such as a single piece fan casing, and they have weak points on the structure in the fan casing pieces connection and on the connection from the motor support to the fan casing. Therefore, these solutions have limited use for heavy-duty applications with competitive cost requirements.

SUMMARY OF THE INVENTION

Accordingly, there is provided according to the invention a packaged fan having independent support vanes supporting the packaged fans on the underlying structure (housing, roof, frame, etc.). The independent support vanes are oriented parallel to the airflow direction, preferably flat or a combination of planar surfaces, with the major plane parallel to the air flow direction. At the center of the fan, the support vanes are attached to the electric motor. The support vanes pass through the fan casing, either through an opening in the fan casing, or through a joint between two fan casing segments, and attach to the underlying structure.

It is specifically noted that every combination and subcombination of the above-listed and below-described features and embodiments is considered to be part of the invention.

BRIEF DESCRIPTION OF DRAWINGS

The foregoing summary, as well as the following detailed description of the preferred invention, will be better understood when read in conjunction with the appended drawings. For the purposes of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

The present invention is a packaged fan having a novel support structure featuring a set of independent vanes supporting the electric motor and extending to outside the fan casing. As the vanes extend outside the fan casing, they can transfer all the mechanical loads from the fan rotor and electric motor directly to the external framework to which/on which the packaged fan is mounted. In this way, packaged fans according to the invention can support higher loads as compared to the same fans with traditional support arrangements, allowing their use on heavy-duty applications without mechanical or vibration problems. Also, as the loads are not transferred through the fan casing, the fan casing can be less reinforced and consequently have a lower weight and cost. The support structure of the invention also allows use of multi-piece fan casings without compromising its mechanical strength which results in a lower cost for the manufacturing tooling such as injection molds. In particular, the use of the support vanes as the main structure connecting the electric motor to the surrounding framework allows the natural frequency of the packaged fan assembly to be outside the fan operating range so resonance and vibration problems are avoided.

Figure 1:
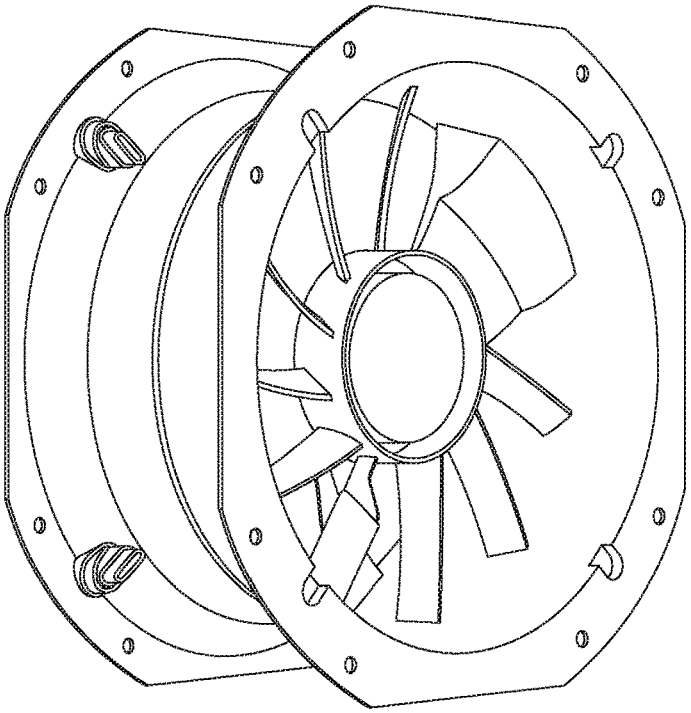
Prior Art FIG. 1
FIG. 1 is a perspective view of a prior art packaged fan.
Figure 2:
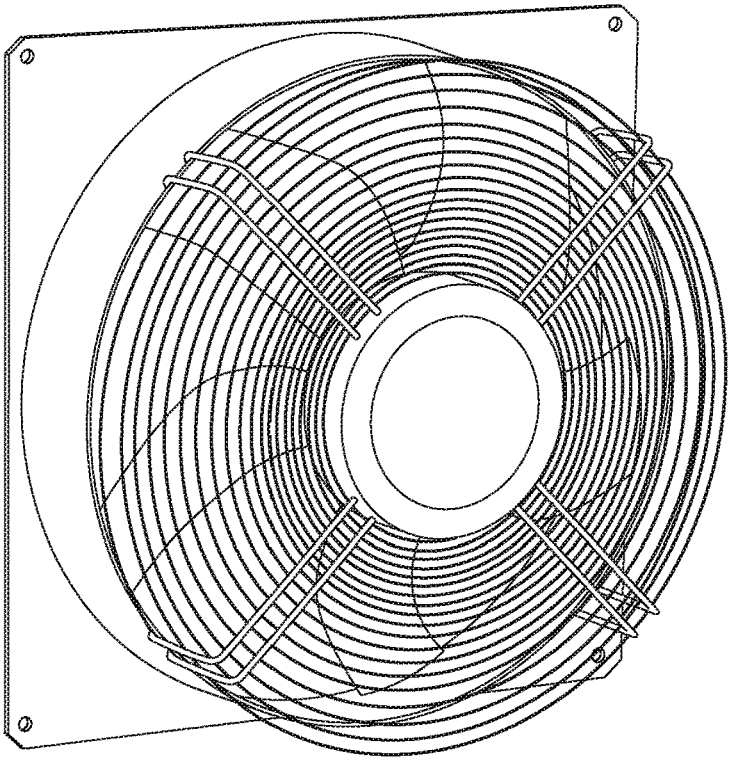
Prior Art FIG. 2
FIG. 2 is a perspective view of another prior art packaged fan.
Figure 3:
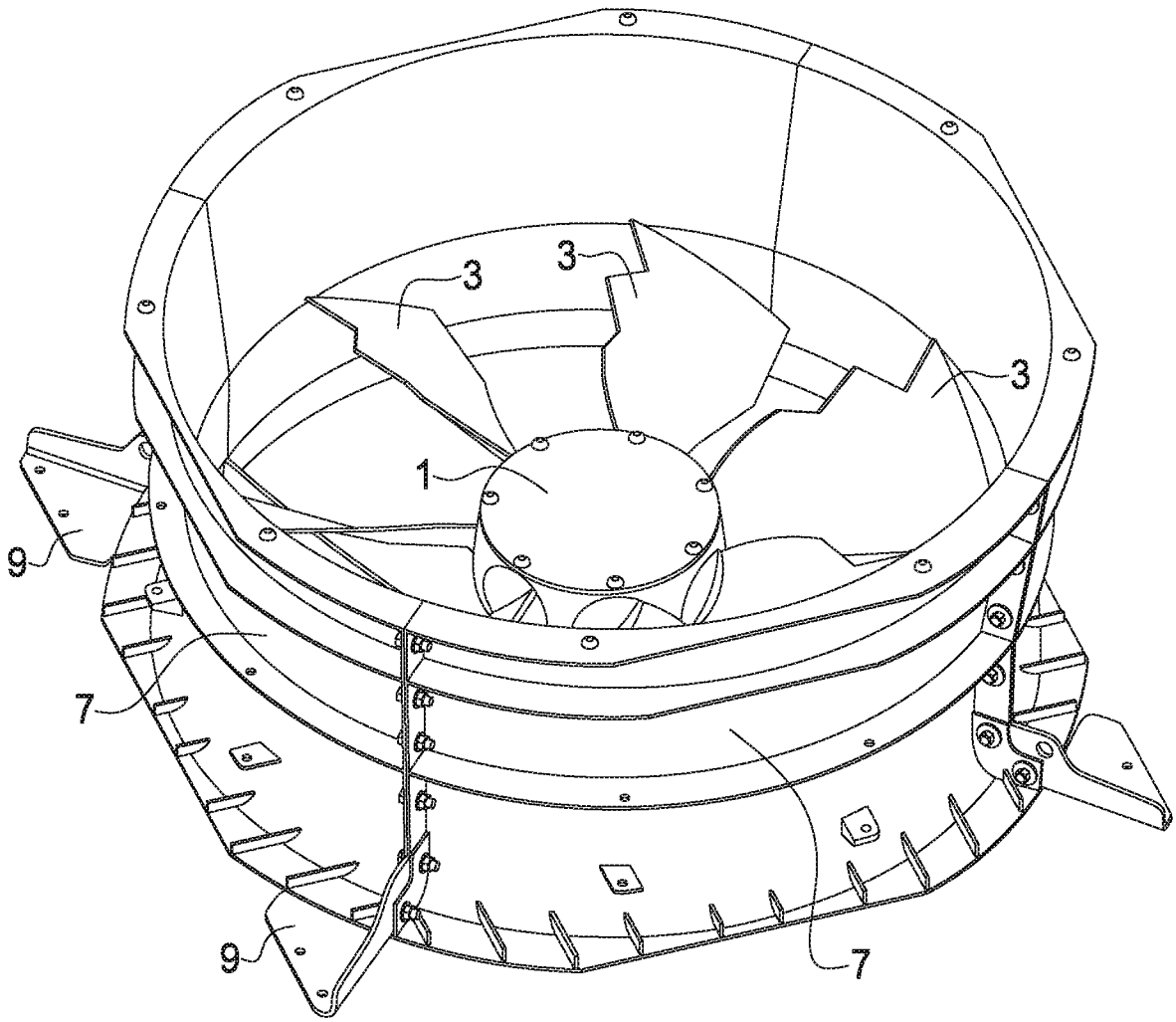
FIG. 3 is a perspective view of a packaged fan according to an embodiment of the present invention.
Figure 4:
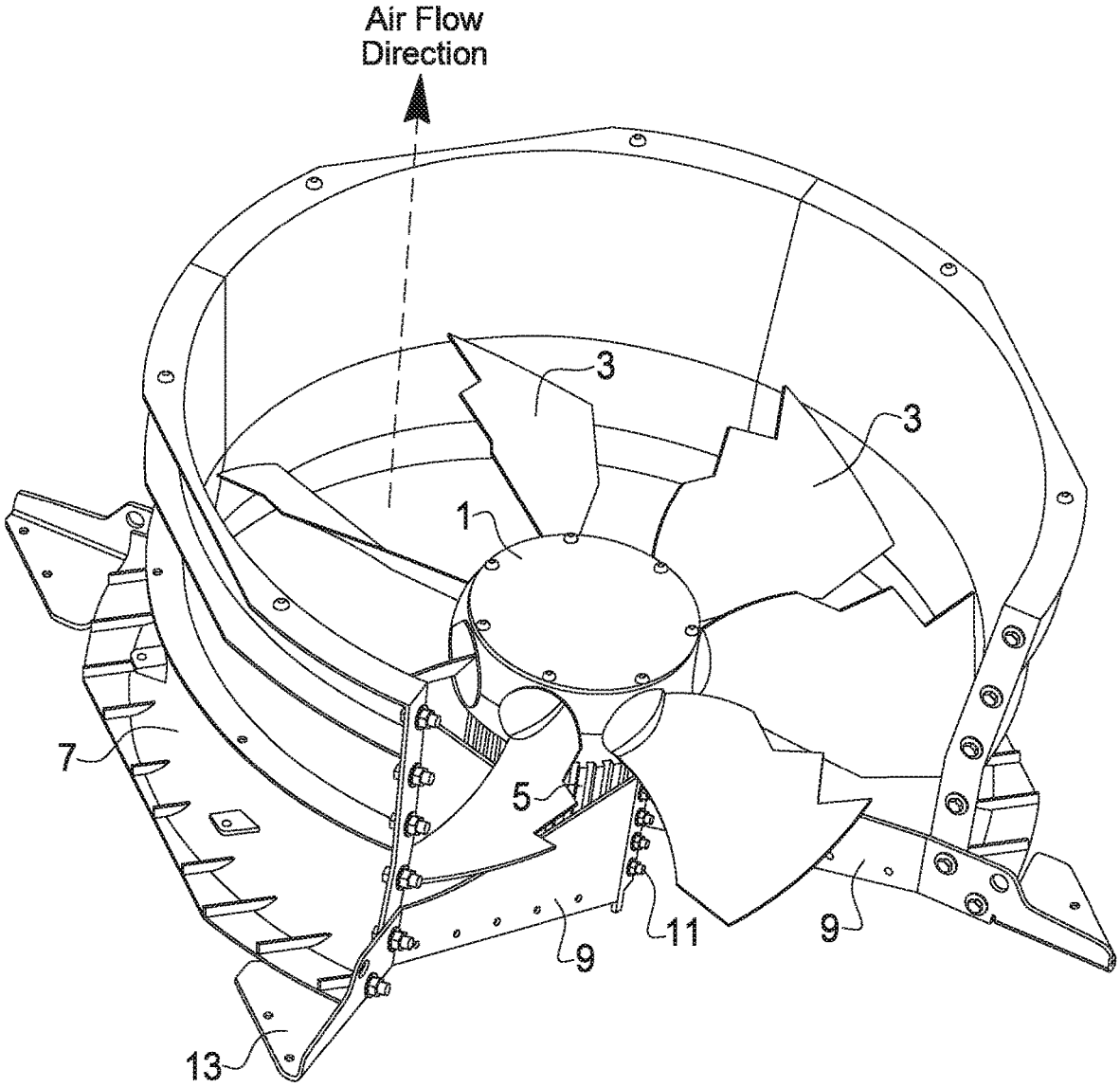
FIG. 4 is a cutaway perspective view of the packaged fan of FIG. 3.

Referring to FIGS. 3 and 4, a packaged fan of the invention includes rotor 1, and fan blades 3, electric motor 5, a fan casing 7, support vanes 9. The fan blades may be attached to the rotor in conventional fashion, and the rotor may be driven by the motor in conventional fashion, although internal rotor electric motors are preferred for reasons set forth below. According to a preferred embodiment, each support vane extends from a proximal end 11 at the center of the fan to a distal end 13 outside the fan casing. At the center of the fan, the proximal ends 11 of the support vanes are attached to the electric motor 5. Support vanes are connected at their distal ends 13 to the framework to which the packaged fan is attached/by which the packaged fan is supported. The framework may be the top or side surface of a cooling tower, cooler, condenser, evaporator housing or other heat exchange unit. The framework may be the roof, walls, columns or beams of a utility or mechanical room which houses heat exchange equipment or of an environment with ventilation requirements. The portion of the support vanes that traverse the air flow path is preferably flat or a combination of planar surfaces, with the major plane of each vane oriented parallel to the air flow. According to one embodiment, the support vanes then pass through an opening in the fan casing vanes and terminate at their distal ends, outside the perimeter of the fan casing. The opening in the fan casing may be a joint between different segments of a multi-part casing, as shown in FIGS. 3 and 4. Alternatively, the opening in the fan casing may be a narrow passaged formed in an integrally formed fan casing or fan casing segment. According to a preferred embodiment, the support vanes are attached to the fan casing, for example by nut and bolt to a flange formed on the fan casing or fan casing segment. By way of non-limiting example, the support vanes shown in FIGS. 3 and 4 are attached to an edge flange parallel to the airflow axis and a bottom flange of fan casing segments perpendicular to the airflow axis. The distal end 13 of the support vanes may be configured to match the shape and orientation of the framework to which it is to be attached. In many cases, the distal end will be flat and oriented perpendicular to the airflow axis as shown in FIGS. 3 and 4. According to various embodiments of the invention, there may be two, three, four or more support vanes. According to some embodiments, one or more support vanes (or all the support vanes) may extend solely from the motor to the support structure, as shown in FIGS. 3 and 4. According to other embodiments, at least one support vane may extend from one part of the support structure to the motor and then to another part of the support structure, for example, extending straight across the fan from one side of the support structure to part of the support structure on an opposite side of the fan (180 degrees) and connected to the motor in the middle, or forming an obtuse or acute angle (less than 180 degrees) where the support vane attaches to the motor.

The packaged fans of the invention do not require any additional structure covering the sides or the front of the electric motor, so the cooling of the motor is improved which increases the maximum temperature it can be operated without exceeding the temperature limit of its materials. According to a preferred configuration, the rotor may be assembled downstream of the motor, which further improves the cooling of the electric motor as the air velocity is higher on the inlet side of the rotor than on the outlet of the rotor behind the hub.

The support vanes are preferably, although not necessarily, independent from one-another-they are not attached to one-another, and they are separately attached to the motor at their proximal ends and separately attached to the support structure at their distal ends. While the support vanes pass through the fan casing, either through an opening in an integrated fan casing or at a joint between segments of a segmented casing, the support vanes do not rely on the fan casing for any strength or support. That is, all the mechanical loads of the fan are supported by the support vanes. Use of independent support vanes makes it possible to use internal rotor electric motors, which have the advantage of having a smaller cross section than external rotor electric motors The reduced cross section of internal rotor electric motors allows the use of a reduced diameter hub on the fan rotor which increases its aerodynamic efficiency and therefore the overall efficiency of the packaged fan. Use of internal rotor electric motors, facilitated by the independent support vanes of the invention, also avoids pressure losses that occur with the increased cross section of external rotor motors which requires a spinner or fixed carenage, bringing additional complexity and cost to the packaged fan.

According to an embodiment of the invention, the support vanes may be positioned upstream of the fan rotor such that they can be straight to increase the stiffness of the whole packaged fan structure without causing additional aerodynamic losses that occur with straight vanes are located downstream of the fan rotor. Nevertheless, it is possible to also use the invention with support vanes located downstream of the rotor.

The preferred configuration for the invention uses steel support vanes and an injected polymer fan casing as it provides the best combination of a) high mechanical strength of the vanes with b) a light, simple and low-cost solution for the fan casing. Nevertheless, other configurations such as injected polymer vanes or metallic fan casings can also be utilized. Additionally, other materials can also be considered for these parts such as fiber reinforced plastics and other metals such as aluminum.

Notwithstanding the specific embodiments, features, elements, combinations and sub-combinations disclosed herein, it is expressly considered and here disclosed that every single element, every single feature, and every combination and sub-combination thereof disclosed herein may be combined with every other element, feature, combination and sub-combination disclosed herein.

It will be appreciated by those skilled in the art that changes could be made to the embodiments described above without departing from the inventive concept thereof. It is understood, therefore, that this invention is not limited to the particular embodiments disclosed, but it is intended to cover modifications within the spirit and scope of the present invention as outlined in the present disclosure and defined according to the broadest reasonable reading of the claims that follow, read in light of the present specification.

The invention claimed is:

1. A packaged fan, comprising:

a rotor with fan blades extending outward from the rotor;

an electric motor coupled to the rotor; and a fan casing surrounding an outside perimeter of the fan blades, wherein a plurality of support vanes extend from the electric motor and through the fan casing to a position outside the fan casing, each support vane of the plurality of support vanes being configured to attach to a support structure and to transmit mechanical loads directly to the support structure.

2. The packaged fan according to claim 1, wherein each support vane of the plurality of support vanes have a planar portion traversing an air flow path, the planar portion having a major plane that is parallel to the air flow path.

3. The packaged fan according to claim 1, wherein the fan casing is a single integral part.

4. The packaged fan according to claim 1, wherein the fan casing comprises multiple segments, and wherein a support vane of the plurality of support vanes extends between two segments of the multiple segments of the fan casing.

5. The packaged fan according to claim 1, wherein each support vane of the plurality of support vanes is secured to the fan casing.

6. The packaged fan according to claim 1, wherein the electric motor is an internal rotor electric motor.

7. The packaged fan according to claim 1, wherein the rotor is positioned downstream of the electric motor.

8. The packaged fan according to claim 1, wherein at least one of the plurality of support vanes extends in two directions from the electric motor to outside the fan casing.

9. The packaged fan according to claim 8, wherein the at least one of the plurality of support vanes extends from one part of the support structure outside of the fan casing to said electric motor and to another part of the support structure outside of the fan casing.

10. A packaged fan, comprising:

a rotor with fan blades extending outward from the rotor;

an electric motor operably connected to the rotor;

a fan casing surrounding the fan blades, wherein the fan casing includes a first segment and a second segment, the first segment and the second segment being separable and connected to each other; and a support vane extending from the electric motor, wherein the support vane passes between the first segment of the fan casing and the second segment of the fan casing.

11. The packaged fan of claim 10, wherein the rotor is positioned downstream of the electric motor.

12. The packaged fan of claim 10, wherein the support vane is configured to attach to a support structure, to attach to a first part of the support structure, and to attach to a second part of the support structure, and wherein a first part of the support vane configured to attach to the first part of the support structure is located less than or equal to 180 degrees from a second part of the support vane configured to attach to the second part of the support structure.

13. The packaged fan of claim 12, wherein the first part of the support vane and the second part of the support vane are positioned outside a perimeter of the fan casing.

14. The packaged fan of claim 10, wherein the electric motor is an internal rotor electric motor.

15. The packaged fan of claim 10, wherein the support vane includes a planar portion traversing an air flow path and a major plane that is parallel to the air flow path.

16. A packaged fan, comprising:

a rotor with fan blades extending outward from the rotor;

an electric motor connected to the rotor, wherein the electric motor is configured to drive the rotor to generate airflow along an airflow axis;

a fan casing surrounding the fan blades, wherein the fan casing includes a flange formed on the fan casing that extends in a direction that is substantially perpendicular to the airflow axis; and a support vane extending from the electric motor and through the fan casing, wherein the support vane includes:

a portion extending substantially perpendicular to the airflow axis and attached to the flange of the fan casing.

17. The packaged fan of claim 16, wherein a distal end of the support vane terminates outside a perimeter of the fan casing at a support structure.

18. The packaged fan of claim 17, wherein the distal end extends substantially perpendicular to the airflow axis.

19. The packaged fan of claim 17, wherein the support vane is configured to attach to a first segment of the support structure, on which the flange is formed, and to a second segment of the support structure having a second flange.

20. The packaged fan of claim 16, wherein the fan casing comprises at least two segments, and wherein the support vane extends from the electric motor and through the fan casing such that the support vane extends between the at least two segments of the fan casing.

* * * * *